US005473924A

United States Patent [19]

Collinson

[11] Patent Number: 5,473,924

[45] Date of Patent: Dec. 12, 1995

[54] ROLLING MILLS

[75] Inventor: Christopher D. Collinson, Upton, England

[73] Assignee: Davy McKee (Poole) Limited, Poole, United Kingdom

[21] Appl. No.: 185,942

[22] PCT Filed: Oct. 28, 1992

[86] PCT No.: PCT/GB92/01976

§ 371 Date: Jan. 14, 1994

§ 102(e) Date: Jan. 14, 1994

[87] PCT Pub. No.: WO93/08938

PCT Pub. Date: May 13, 1993

[30] Foreign Application Priority Data

Nov. 1, 1991 [GB] United Kingdom ..... 9123245

[51] Int. Cl.[6] ..... B21B 45/04; B21B 28/00

[52] U.S. Cl. ..... 72/236; 72/39

[58] Field of Search ..... 72/39, 201, 236; 15/302, 306.1, 309.1, 309.2

[56] References Cited

U.S. PATENT DOCUMENTS

| | | | |
|---|---|---|---|
| 4,061,010 | 12/1977 | Stock et al. | 72/236 |
| 4,718,264 | 1/1988 | Guppy et al. | 72/236 |
| 5,046,347 | 9/1991 | Crosato et al. | 72/236 |
| 5,081,857 | 1/1992 | Matsui et al. | 72/236 |

*Primary Examiner*—Lowell A. Larson
*Assistant Examiner*—Rodney A. Butler
*Attorney, Agent, or Firm*—Lee, Mann, Smith, McWilliams, Sweeney & Ohlson

[57] ABSTRACT

In a rolling mill for following aluminum strip, it is desirable to apply water to the rolls on the entry side of the mill. Water should be kept off the surface of the rolled strip to avoid marking and, to this end, a moisture extraction device is arranged to collect moisture passing between the upper work roll and its back-up roll. The device includes an extractor system connected to a head assembly located in the cusp between the work roll and its back-up roll on the exit side of the mill.

5 Claims, 3 Drawing Sheets

ROLLING MILLS

This invention relates to rolling mills and in particular to rolling mills for cold rolling aluminium strip.

The final rolling stages of aluminium strip consist of rolling the strip through a number of rolling mill stands, sometimes arranged in tandem, so that the strip leaving the last stand is of the required gauge. This strip is then coiled for subsequent use. The rolls of the mill stands are cooled by having liquid coolant applied to them on the entry side and it has been the practice to employ kerosene as the liquid coolant. However, for various reasons, it would be preferable to use water as the liquid coolant, but it is absolutely vital to keep water off the strip on the exit side of the mill when it is coiled because water left on the surface of the coiled strip dries and causes considerable staining of the strip rendering it unacceptable to many potential users.

Each of the mill stands consists of a pair of work rolls arranged one above the other and each work roll is backed up by a separate back-up roll. The liquid coolant is applied to both the work rolls and the back-up rolls on the entry side of the mill stands and steps are usually taken to contain the liquid coolant on the entry side of the stand and to limit, as far as possible, the movement of the liquid coolant to the surfaces of the rolls at the exit side of the stands in order to prevent moisture being deposited on the strip and which may eventually cause staining of the strip.

In practice, it has been found hat moisture may penetrate between the upper work roll and its back-up roll and collect in the cusp at the exit side of the mill between the upper work roll and its back-up roll. Furthermore, even if the liquid coolant applied to the back-up roll on the entry side is contained within a chamber which is sealed along its length to the periphery of the back-up roll, there may be some leakage through the seal between the chamber and the upper back-up roll and this permits some moisture to collect on the periphery of the upper back-up roll and be taken to the cusp between this roll and its work roll on the exit side.

It is an object of the present invention to provide a moisture extraction device for such a rolling mill by which moisture which collects at this cusp can be removed.

According to the present invention, for use with a rolling mill having a pair of work rolls each backed-up with the back-up roll, a moisture extraction means is characterised in that it comprises a head assembly shaped to enter into and extend along the length of the cusp between the upper work roll and its back-up roll on the exit side of the mill; an extractor system connected to the head assembly and including suction generating means by which, in use, air is sucked from the cusp through the head assembly into the extractor system whereby moisture present in the cusp is drawn with the air into the extractor system.

With a rolling mill fitted with a moisture extraction device in accordance with the present invention, moisture which may collect at the cusp between the upper work roll and its back-up roll at the exit side of the mill is removed so that it cannot fall on to the upper surface of the strip material where, if it is water and the strip is aluminium, it could bring about staining of the material.

The extractor system includes ducting which connects the head assembly with suction generating means and the ducting has quick-release joints at its connections to the head assembly and suction generating means. The quick-release joints may be operated simultaneously. This arrangement of the ducting and the quick-release joints is particularly convenient if the head assembly is supported from the bearing chocks of the upper work roll so that, when the work roll is to be replaced, the head assembly is removed with the work roll and its chocks. To enable quick-release and re-connection of the joints, the release joints between the ducting and the head assembly and the suction generating means can be released simultaneously, the roll changed and the connections re-made simultaneously with the minimum of delay.

To ensure that moisture present at the ends of the cusp between the two rolls is drawn into the extractor system, it is convenient for the head assembly to include at least one nozzle at each end with the nozzles being directed into the cusp in the direction from the ends thereof and air under pressure is supplied to the nozzles to blow any moisture at the ends of the head assembly towards the central region of the head assembly where it can be readily withdrawn with the air being drawn through the head assembly.

In order that the invention may be more readily understood, it will now be described, by way of example only, with reference to the accompanying drawings, in which.

Figure 1:
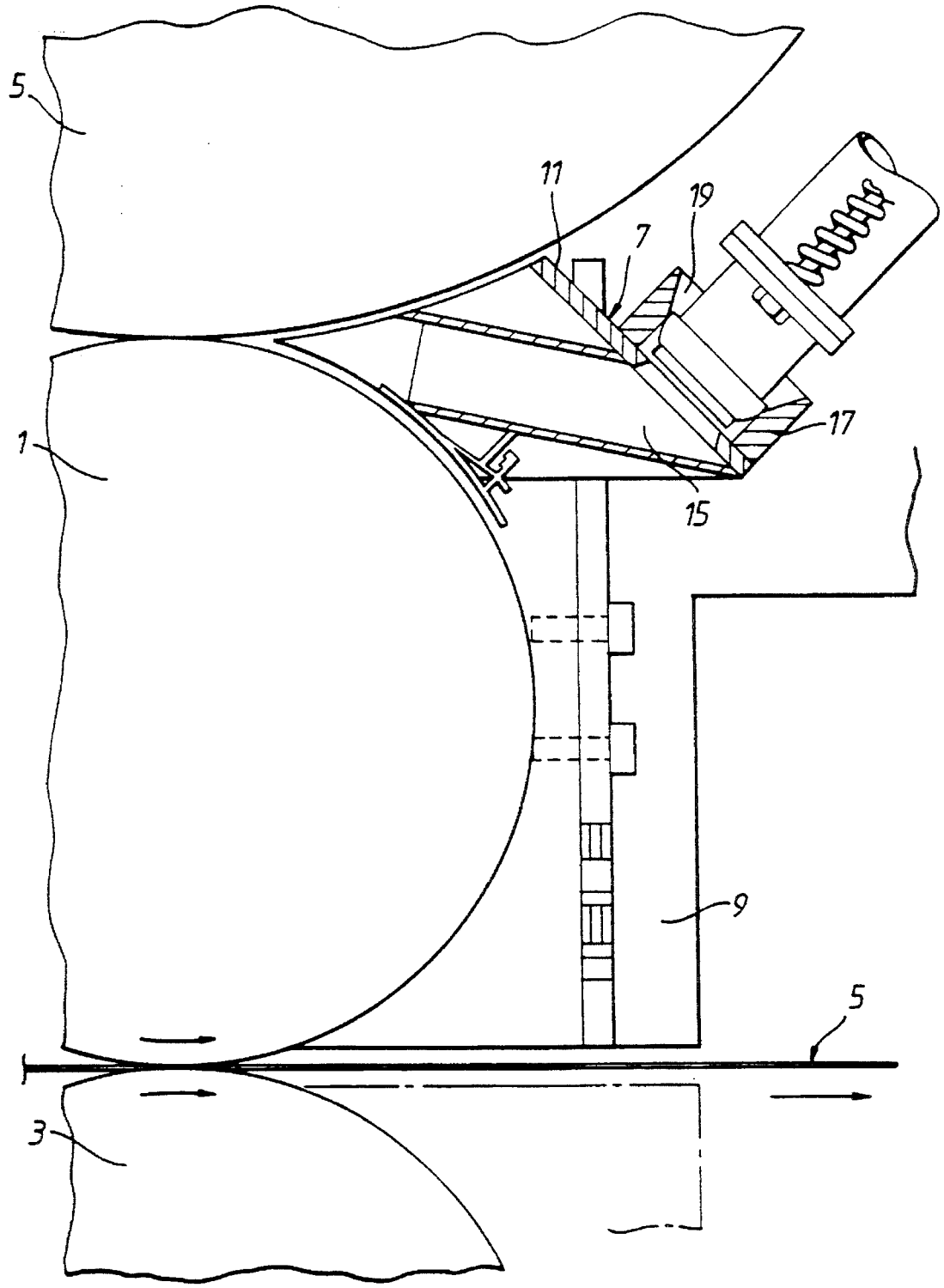
FIG. 1 is a sectional side elevation of part of a rolling mill illustrating the present invention.

A rolling mill for cold rolling aluminium strip comprises a pair of work rolls 1, 3 arranged one above the other and each backed-up by a back-up roll, the upper back-up roll 5 being illustrated. The strip being rolled between the work rolls of the rolling mill is indicated by reference S.

At the cusp between the upper work roll 1 and its back-up roll 5 on the exit side of the mill there is a head assembly 7 which extends for the length of the rolls. The head assembly is supported at its ends by any convenient means from the bearing chock assemblies 9 of the work roll. The head assembly 7 comprises a backing plate 11 having shaped end pieces attached to it which enables it to be positioned closely within the cusp between the rolls. The plate 11 and the end pieces support a plurality of tubes 15 which communicate with unions 17 on the plate 11 and positions close to the surfaces of the two rolls. Each union provides a tapered socket 19.

Figure 2:
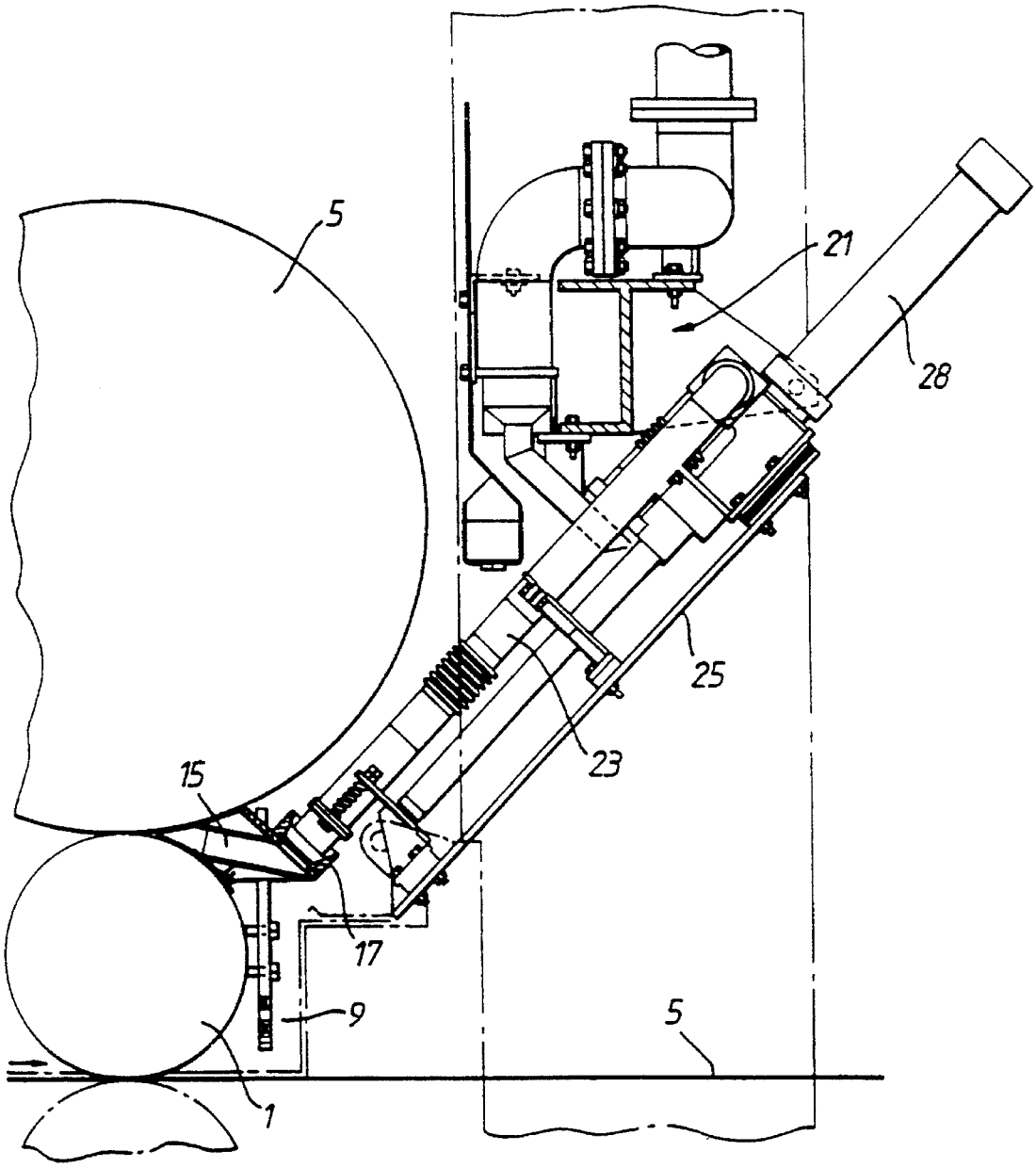
FIG. 2 is a side elevational of a rolling mill showing the ducting between the head assembly and the suction generating means.

At a position away from the cusp between the rolls there is provided on the mill housing suction generating means, indicated generally by reference 21 in FIG. 2. This forms part of an extractor system connected to the head assembly. Ducting 23 is provided between the suction generating means 21 and each of the unions 17 on the head assembly. The ducting is supported on a movable plate 25 and it comprises two U-shaped ducts 26 each having a connecting duct 27 in communication with the central region of the duct. The two outer ends of the ducts 26 and the outer end of the connection duct 27 each have tapered surfaces corresponding to the tapered surfaces 19 on the unions 17 and a similarly tapered surface on a union on the suction generating means. The U-shaped ducts mounted on the plate 25 include bellow sections 26' such as to permit limited relative movement between the ends of the ducts and the plate in the direction of the length of the limbs of the ducts. A piston-cylinder device 28 is supported from the mill housing and is connected to the plate 25. On actuating the device 28, the plate is moved on guides whereby the ends of the ducts can be displaced in the direction towards and away from the unions with which they connect so that they can be quickly and simultaneously released from the unions to enable the work roll to be removed and replaced as required.

Figure 3:
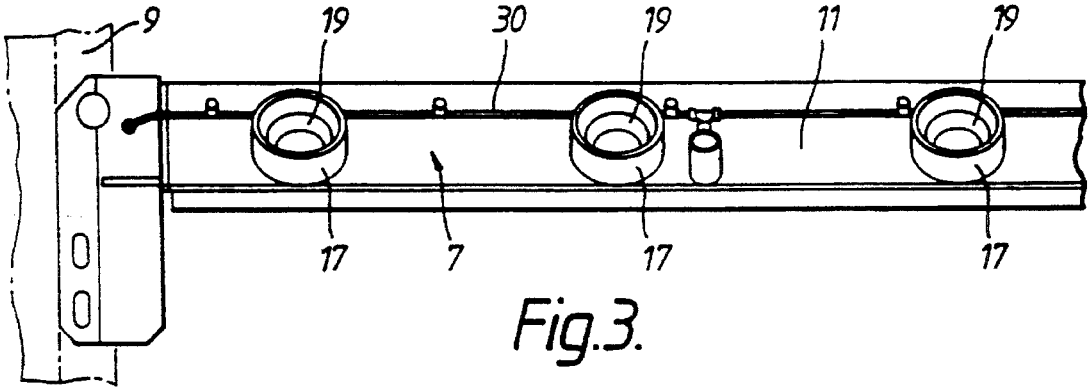
FIG. 3 is a plan view of a head assembly.
Figure 4:
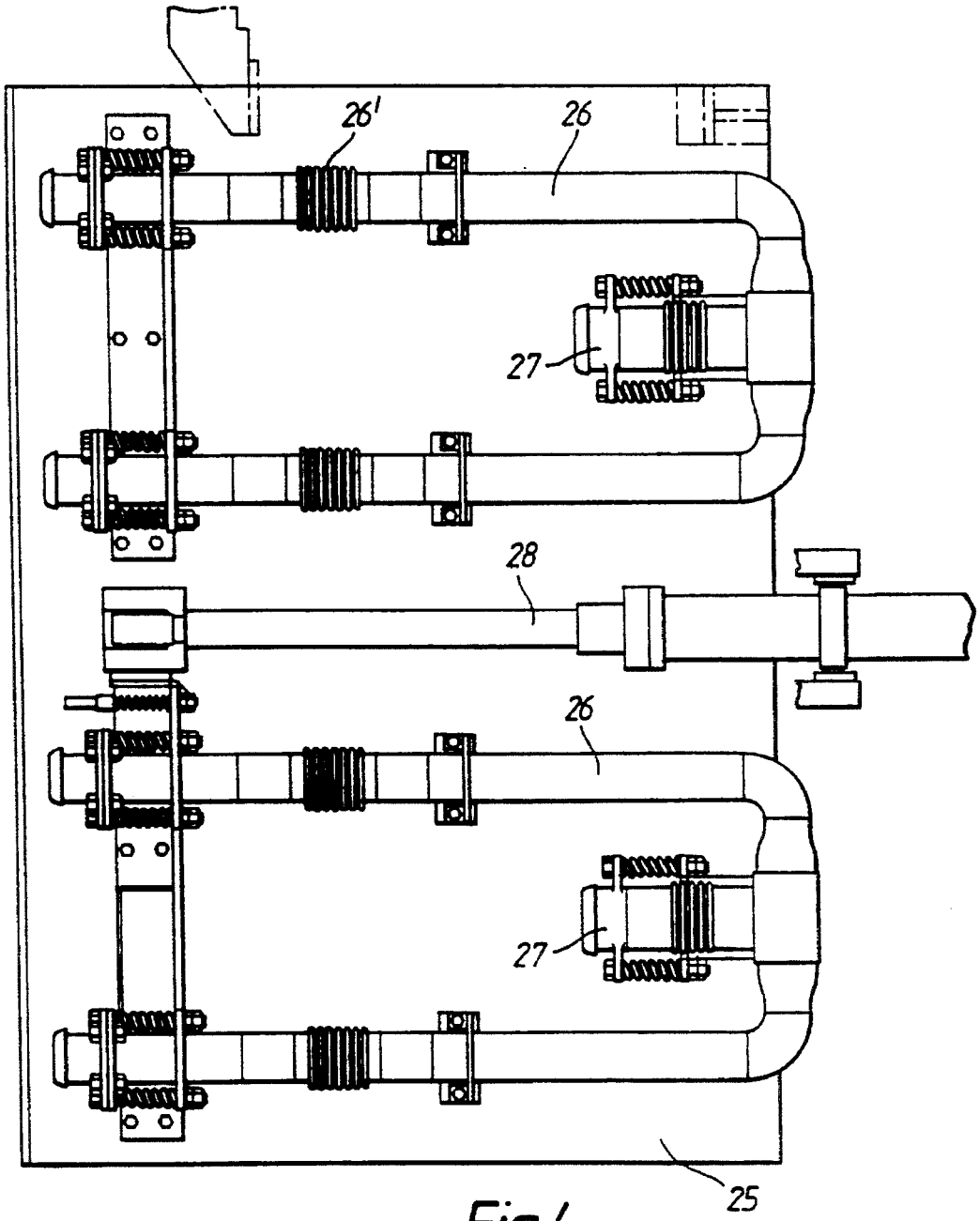
FIG. 4 is a plan of the ducting.

At the ends of the head assembly there are a pair of nozzles (not shown) which are connected to an air supply by a tube 30 (FIG. 3). The air nozzles are so directed that the air issuing from the nozzles is applied from the ends of the cusp towards the central region thereof to blow any moisture present at the ends of the cusp towards the pipes 15 within the head assembly.

In use, any moisture, particularly water, which tends to collect in the cusp and which, in the absence of the invention, may fall on to the upper surface of the strip just before it is coiled, is, by means of the extractor system, removed from within the cusp through the head assembly.

I claim:

1. A moisture extraction means for use with a rolling mill having upper and lower work rolls and upper and lower back-up rolls each mounted in a bearing chock assembly, said moisture extraction means comprising a head assembly arranged to be supported from the bearing chock assembly of the upper work roll and shaped to enter into and extend along the length of the cusp between the upper work roll and the upper back-up roll on the exit side of the mill;

suction generating means positioned remote from the head assembly and ducting connecting the head assembly and the suction generating means, whereby moisture present in the cusp is drawn into the extraction means, said ducting including quick release joints at its connections with the head assembly and the suction generating means.

2. Moisture extraction means as claimed in claim 1 wherein the head assembly includes an elongate backing plate having a pair of opposite ends and a pair of opposite sides, projections at said ends of the plate shaped to enter into said cusp, said projections and one side of said backing plate together defining a space, a plurality of unions spaced apart along the length of the backing plate on the opposite side thereof and a plurality of tubes communicating with the space and with each of the unions.

3. Moisture extraction means as claimed in claim 1, characterised in that nozzles are located on the head assembly at the ends thereof, said nozzles being directed inwardly of the end pieces towards the central region of the head assembly and means for supplying air under pressure to the nozzles.

4. Moisture extraction means as claimed in claim 2 wherein the ducting is connected by way of quick release joints with said unions and means are provided for operating all the quick release joints simultaneously.

5. Moisture extraction means as claimed in claim 4, wherein all the ducting is mounted on a movable support plate and means are provided for displacing the support plate and the ducting between a first position in which the connections between the ducting and the unions and the suction generating means are made and a second position in which the connections are broken.

* * * * *